US008602598B2

(12) United States Patent
Duan et al.

(10) Patent No.: US 8,602,598 B2
(45) Date of Patent: Dec. 10, 2013

(54) LIGHT SOURCE COOLING DEVICE AND COOLING METHOD THEREOF

(75) Inventors: Sheng-Shing Duan, Hsinchu (TW); Shih-Chin Chou, Kaohsiung (TW)

(73) Assignee: Lextar Electronics Corp., Hsinchu (TW)

( * ) Notice: Subject to any disclaimer, the term of this patent is extended or adjusted under 35 U.S.C. 154(b) by 0 days.

(21) Appl. No.: 13/611,371

(22) Filed: Sep. 12, 2012

(65) Prior Publication Data

US 2013/0083546 A1 Apr. 4, 2013

(51) Int. Cl.
*F21V 29/00* (2006.01)

(52) U.S. Cl.
USPC ..... 362/294; 362/218; 362/373; 362/264

(58) Field of Classification Search
CPC ..... F21V 26/262; F21V 29/00; F21V 3/005
USPC ..... 362/373, 249.02, 249.01, 126, 545, 362/362; 313/45–46, 12
See application file for complete search history.

(56) References Cited

U.S. PATENT DOCUMENTS

| | | | | |
|---|---|---|---|---|
| 7,874,702 | B2 * | 1/2011 | Shuai et al. | 362/294 |
| 2010/0301724 | A1 * | 12/2010 | Chu | 313/45 |
| 2011/0051453 | A1 * | 3/2011 | Nagasawa et al. | 362/547 |
| 2011/0095671 | A1 * | 4/2011 | Chu | 313/46 |

* cited by examiner

*Primary Examiner* — Tracie Y Green
(74) *Attorney, Agent, or Firm* — Muncy, Geissler, Olds & Lowe, PLLC

(57) ABSTRACT

A light source cooling device includes a light source module, an inner casing, an outer casing, and a plurality of spacers. The inner casing encloses an accommodation space for accommodating the light source module. The outer casing surrounds the inner casing and has a gap included between an inner wall of the inner casing and the outer casing, wherein the inner casing and the outer casing are made of materials with different thermal conductivity coefficients. The inner wall of the inner casing, an outer wall of the outer casing, and the spacers together form a plurality of heat-dissipating passages. The inner wall absorbs the heat generated by the light source module and generates a temperature gradient between the inner wall and the outer wall, which assists in creating thermal convection to exhaust the heat.

24 Claims, 10 Drawing Sheets

LIGHT SOURCE COOLING DEVICE AND COOLING METHOD THEREOF

CROSS REFERENCE TO RELATED APPLICATIONS

This application claims priority of U.S. Provisional Application No. 61/541,611 filed on Sep. 30, 2011 under 35 U.S.C. §119(e), the entire contents of all of which are hereby incorporated by reference.

BACKGROUND OF THE INVENTION

1. Field of the Invention

The present invention relates generally to a light source cooling device and a cooling method thereof; particularly, the present invention relates to a light source cooling device and a cooling method thereof that dissipates heat by convection in an inner cavity.

2. Description of the Prior Art

In current lamp technologies, it is an important consideration for lamp structure design to effectively dissipate the waste heat generated by the light source to avoid overheating the lamp or burning users.

FIG. 1 is a schematic view of a conventional lamp 10. As shown in FIG. 1, the conventional lamp 10 includes a light source module 11, an inner casing 20, and a plurality of fins 40, wherein the light source module 11 is disposed in a space surrounded by the inner casing 20. The fins 40 extend from the inner casing 20, wherein the inner casing 20 and the fins 40 together form a plurality of semi-opening heat-dissipating passages 50.

While generating light, the light source module 11 also generates waste heat, wherein the waste heat causes the increase in temperature of the inner casing 20 and of the air in the heat-dissipating passages 50. When the light source module 11 initially generates the light as well as the waste heat, the temperatures of the outer surfaces of the fins 40 and of the inner casing 20 are much higher than the temperature of the air in the heat-dissipating passages 50. As such, the fins 40 transfer the waste heat generated by the light source module 11 to the air of the heat-dissipating passages 50 by convection so as to dissipate the waste heat generated by the light source module 11 out of the conventional lamp 10, achieving the heat dissipation effect.

However, as the light source module 11 continues generating the light and the waste heat, the temperatures of the air in the heat-dissipating passages 50, of the outer surface of the inner casing 20, and of the fins 40 will finally reach a thermal equilibrium state. In the meantime, the area of the conventional lamp 10 for dissipating heat is restricted to the surface area of the inner casing 20 and the fins 40 that contacts external air. Hence, the heat-dissipating performance of the conventional lamp 10 is reduced in response to the reduction of heat-dissipating area.

From above, there is still a need to improve the heat-dissipating structure and the heat-dissipating performance of the conventional lamp 10.

SUMMARY OF THE INVENTION

It is an object of the present invention to provide a cooling device for a light source and a cooling method thereof that dissipates heat generated from light emission of the light source to increase the light source reliability and the life time as well as avoid overheating the surface of the light source cooling device to scald operators.

It is an object of the present invention to provide a light source cooling device and a cooling method thereof, wherein the light source cooling device generates a temperature gradient in the inner cavity, which assists in creating the thermal convection effect to dissipate heat.

The light source cooling device includes a light source module, an inner casing, an outer casing, and a plurality of spacers. The inner casing has a supporting portion and an inner wall, wherein the inner wall encloses the supporting portion to form an accommodation space for accommodating the light source module. The outer casing has an outer wall surrounding the inner casing, wherein a gap is included between the outer wall and the inner wall. In addition, the inner casing and the outer casing are respectively made of a first material and a second material that have different thermal conductivity coefficients, wherein the thermal conductivity coefficient of the second material is smaller than the first thermal conductivity coefficient of the first material.

The spacers of the light source cooling device are located within the gap between the inner wall and the outer wall, wherein the spacers preferably extend from an inner surface of the outer wall toward the inner wall and are connected to an outer surface of the inner wall. In addition, the outer wall, the inner wall, and the spacer together form a plurality of heat-dissipating passages. The inner wall transfers the heat generated by the light source module and generates a temperature gradient between the inner wall and the outer wall, wherein the temperature gradient creates a convection of the air within the heat-dissipating passages to dissipate the heat out of the heat-dissipating passages.

In the present invention, the gap between the inner wall and the outer wall preferably has a fixed width, but is not limited to the embodiment; in different embodiments, the width of the gap selectively increases or decreases from the bottom of the inner wall toward the top of the inner wall. In addition, the outer wall forms a curved surface and bends outward relative to the inner wall, resulting the change in width of the gap, but is not limited to the embodiment. In addition, the spacer preferably has a fixed width, but is not limited to the embodiment; in different embodiments, the width of the spacer near the inner wall is selectively smaller than the width of the spacer near the outer wall. In addition, the outer wall alternatively waves along a circumferential direction of the inner casing, so that the width of gap varies along a direction that the outer wall surrounds the inner case.

DETAILED DESCRIPTION OF THE PREFERRED EMBODIMENT

The present invention provides a cooling device for a light source and a cooling method thereof that dissipates heat generated from light emission of the light source to increase the light source reliability and the life time and also to avoid overheating the surface of the light source cooling device to scald operators.

Figure 1:
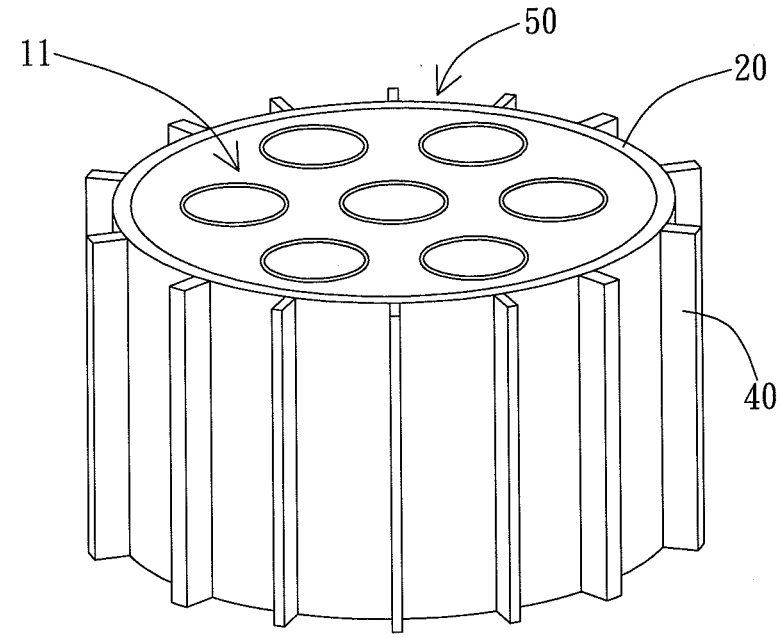
FIG. 1 (PRIOR ART)
FIG. 1 is a schematic view of a conventional lamp.
Figure 2:
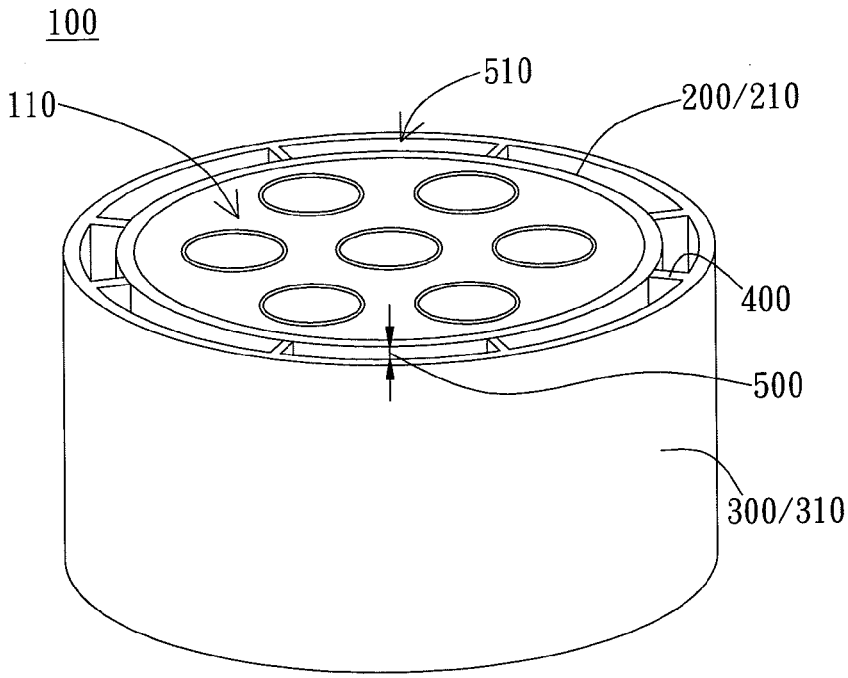
FIG. 2 and FIG. 3 are a schematic view and a top view of a cooling device of the present invention.
Figure 3:
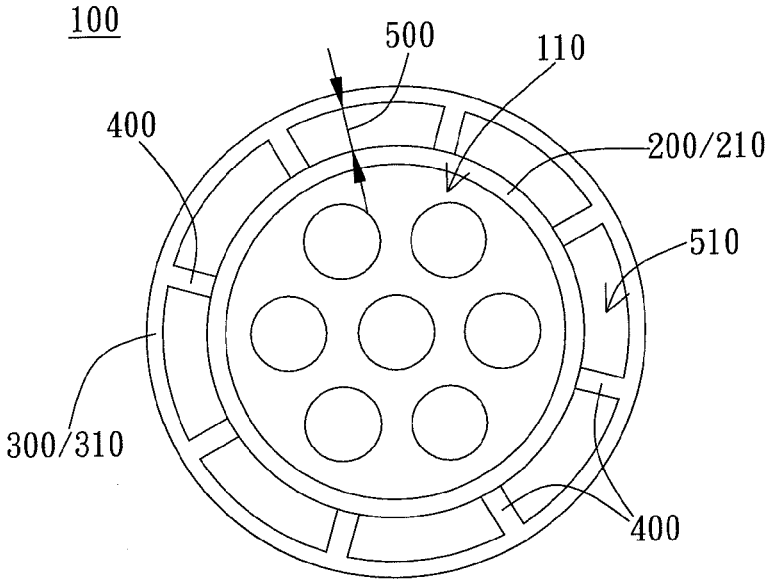

FIG. 2 and FIG. 3 are respectively a schematic view and a top view of a cooling device 100 of the present invention, wherein the cooling device includes a light source module 110, an inner casing 200, an outer casing 300, and a plurality of spacers 400. As shown in FIGS. 2 and 3, the light source module 110 is surrounded by the inner casing 200, and the inner casing 200 is surrounded by the outer casing 300, wherein a gap 500 is included between the inner casing 200 and the outer casing 300. In addition, in the present embodiment, the light source module 110 preferably includes a plurality of light emitting diodes (LEDs), wherein the LEDs can emit the same color light or emit different color light, but not limited thereto; in other embodiments, the light source module 110 can include gaseous discharge lamps, halogen lamps, or other conventional light sources.

As shown in FIGS. 2 and 3, the spacers 400 are located within the gap 500 between an inner wall 210 of the inner casing 200 and an outer wall 310 of the outer casing 300, wherein the spacers 400 of the present embodiment extend from an inner surface of the outer wall 310 toward the inner wall 210 and are connected to an outer surface of the inner wall 210. In addition, the outer wall 310, the inner wall 210, and the spacers 400 together form a plurality of heat-dissipating passages 510, wherein the spacers 400 and the heat-dissipating passages 510 are distributed alternatively in the gap 500. In addition, in the embodiment, the spacers 400 and the heat-dissipating passages 510 are radically formed in the gap 500 with the light source module 110 as the center, but not limited thereto. In other embodiments, the spacers 400 and the heat-dissipating passages 510 may have a square shape or other shapes in the gap 500 according to the shape or heat-dissipating requirement of the cooling device 100.

Figure 4:
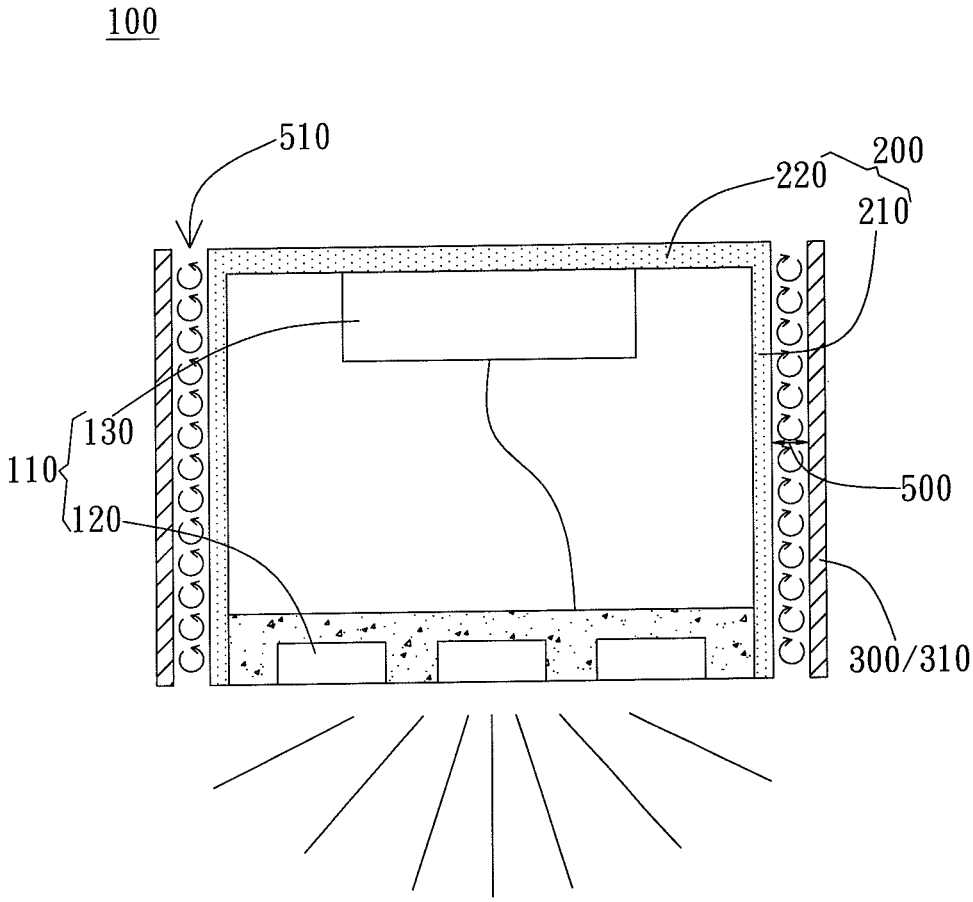
FIG. 4 is a cross-sectional view of the cooling device shown in FIGS. 2 and 3.
Figure 5:
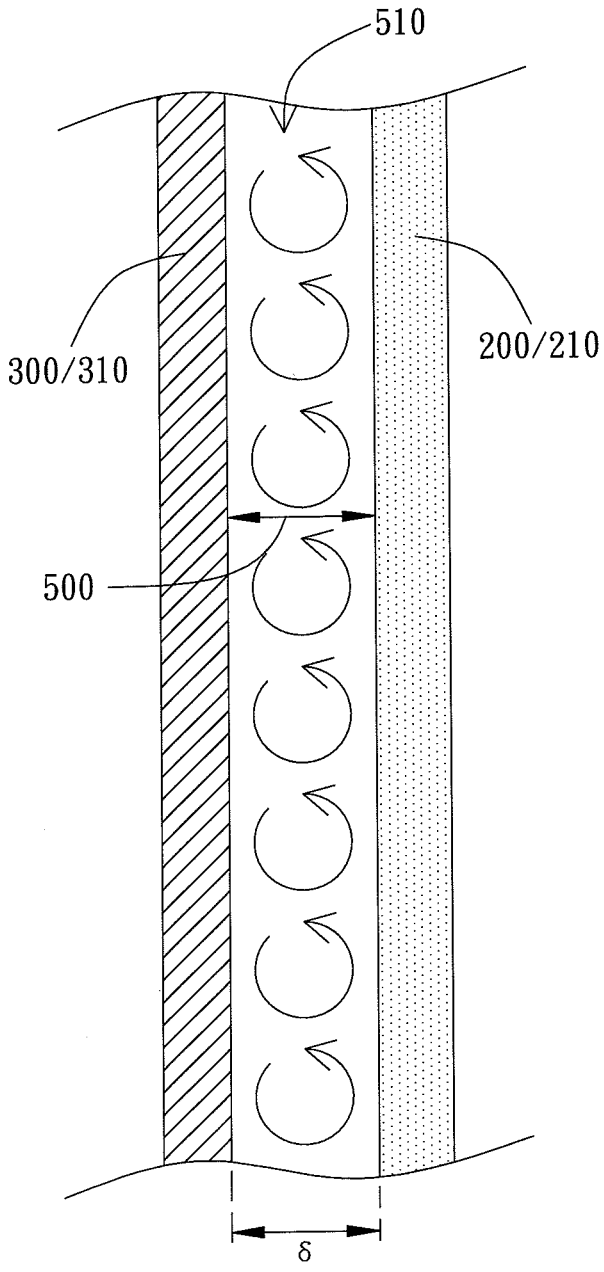
FIG. 5 is an enlarged view of the heat-dissipating passage shown in FIG. 4.

FIG. 4 is a cross-sectional view of the cooling device 100 shown in FIGS. 2 and 3. FIG. 5 is an enlarged view of the heat-dissipating passage 510 shown in FIG. 4. As shown in FIGS. 4 and 5, the inner casing 200 further includes a supporting portion 220, wherein the inner wall 210 encloses the supporting portion 220 to form an accommodation space for accommodating a light-emitting module 120 included in the light source module 110 and a driving module 130 for driving the light-emitting module 120 to generate light. In addition, two ends of the heat-dissipating passage 510 formed by the inner wall 200, the outer wall 300, and the spacers 400 are openings, so that air can flow through the heat-dissipating passage 510.

In addition, the inner casing 200 and the outer casing 300 are made of materials having different thermal conductivity coefficients, wherein the thermal conductivity coefficient of the inner casing 200 is larger than the thermal conductivity coefficient of the outer casing 300. In the present embodiment, the inner casing 200 and the outer casing 300 are made of heat-dissipating plastic materials or metals having higher thermal conductivity coefficient, but not limited thereto. In other embodiments, the inner casing 200 and the outer casing 300 can be made of metals having different thermal conductivity coefficients or other materials. In addition, in the embodiment of FIG. 4, a ratio of the height of the inner wall 210 of the inner casing 200 to the width of the gap 500 is essentially 10, but the ratio is not limited to the embodiment. The ratio of the height of the inner wall 210 of the inner casing 200 to the width of the gap 500 can be modified to be in a range between 10 and 40 or between other suitable values according to the requirement of heat-dissipating performance of the cooling device 100.

In the embodiment shown in FIGS. 4 and 5, the light-emitting module 120 generates light along with waste heat according to the electrical signal of the driving module 130, wherein the waste heat will make the temperature of the inner wall 210 increase. When the light-emitting module 120 initially generates light as well as waste heat, the temperature of the bottom of the cooling device 100 (i.e. the end that is close to the light-emitting module 120) is much higher than the top of the cooling device 100 (i.e. the end that is close to the driving module 130). The difference in temperature between the two ends causes the temperature at the bottom of the heat-dissipating passage 510 (i.e. the end that is near the light-emitting module 120) to be higher than the top of the heat-dissipating passage 510 (i.e. the end that is near the driving module 130). The difference in temperature between the two ends of the heat-dissipating passage 510 causes the hot air generated at the bottom of the heat-dissipating passage 510 to flow upward through the heat-dissipating passage 510 and finally leave from the top of the heat-dissipating passage 510. In addition, the flow of hot air is induced by the difference in air density and humidity in the heat-dissipating passage 510, so that such air flow induced by the difference further draws the air at the bottom of the heat-dissipating passage 510 through the heat-dissipating passage 510 and repeats such actions. Therefore, the thermal energies of the heat-dissipating passage 510 and of the surfaces of the inner casing 200 and the outer casing 300 are exchanged, further achieving the goal of lowering the temperature.

After the light source module 110 continues generating light for a certain time, the temperature of the inner wall 210 of the inner casing 200 will gradually become uniform. Since the thermal conductivity coefficient of the outer wall 310 is smaller than the thermal conductivity coefficient of the inner wall 210, the thermal energy dissipated from the surface of the inner wall 210 will not cause the surface temperature of the outer wall 310 to significantly increase. In other words, there is a significant difference in temperature between the inner wall 210 and the outer wall 310.

As shown in FIG. 4, the difference in temperature between the surfaces of the inner wall 210 and the outer wall 310 generates a temperature gradient. In the temperature gradient, the air near the inner wall 210 having higher temperature moves to the outer wall 310 due to natural convection. That is, a plurality of spinning vortexes are generated in the heat-dissipating passage 510. In addition, because the temperature of the vortexes via spinning flow and exchange of thermal energy with the inner wall 210 is higher than the temperature of the air outside the cooling device 100, so that the vortexes spin and simultaneously move toward the top of the heat-dissipating passage 510 to dissipate the waste heat generated from the light source module 110 out of the cooling device 100. In other words, the vortexes generated from the temperature gradient of the heat-dissipating passage 510 effectively carry the waste heat out of the cooling device 100.

In addition, since the inner wall 210 and the outer wall 310 have different thermal conductivity coefficients, the inner wall 210 and the outer wall 310 continuously maintain the temperature gradient. In other words, even the overall temperature of the inner wall 210 achieves the thermal equilibrium state, the cooling device 100 can continuously utilize the natural convection generated by the temperature gradient to carry the waste heat out of the heat-dissipating passage 510. In addition, the natural convection of the heat-dissipating passage 510 prevents the temperature of the outer wall 310 from approaching the temperature of the inner wall 210, further preventing the user from getting hurt caused by touching the high temperature surface of the outer wall 310 when operating the light source module.

Figure 6:
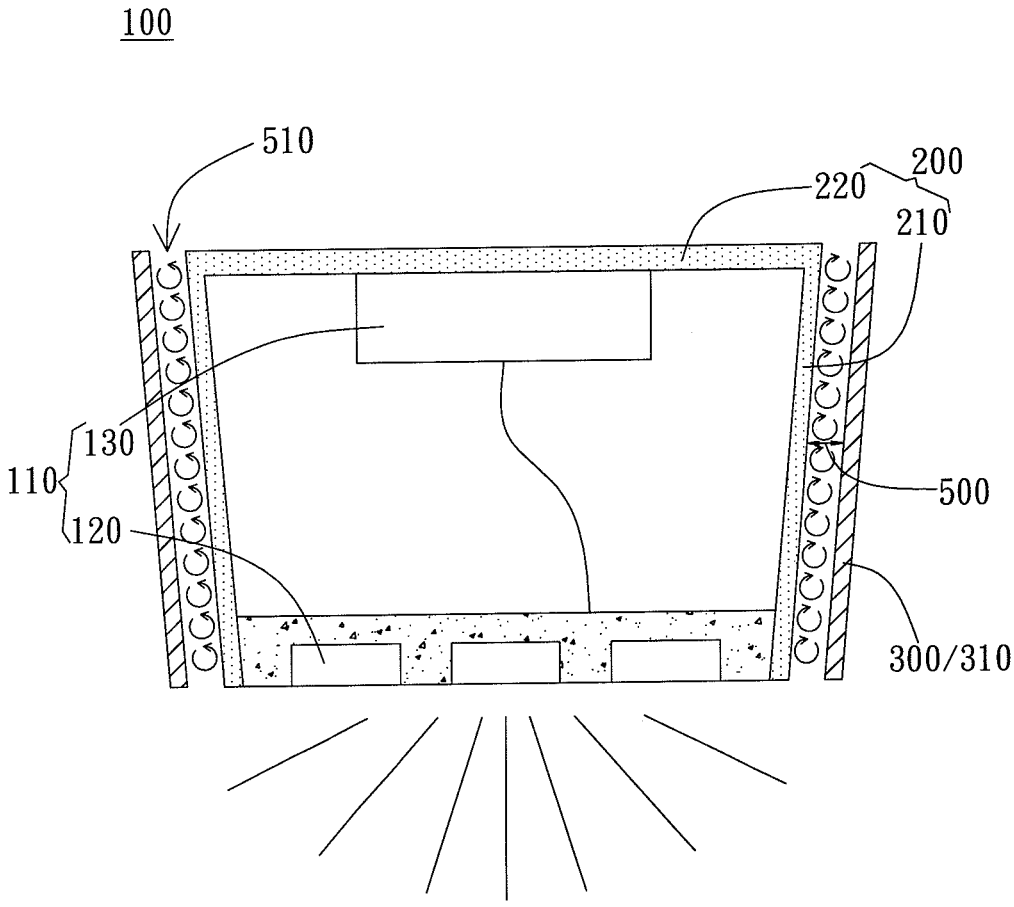
FIG. 6 is a variant embodiment of the light source cooling device shown in FIG. 4.

In the embodiment shown in FIG. 4, the extending directions of the inner wall 210 and the outer wall 310 essentially are vertical to the supporting portion 220 or the extending direction of the light source module 110, but not limited thereto. In the embodiment shown in FIG. 6, the extending directions of the inner wall 210 and the outer wall 310 are not vertical but oblique with respect to the plane of the supporting portion 220. In other words, the inner wall 210 and the outer wall 310 of the present embodiment extend along a direction, which is tilted with respect to the plane of the supporting portion 220. The heat of the light source module 110 is transferred from the cooling device 100 to the surrounding air by natural convection, further decreasing the operating temperature of the LEDs and increasing the life time of the LEDs. The cooling device 100 shown in FIG. 6 is essentially the same as the cooling device 100 shown in FIG. 4 with regard to the operation aspect and the structure aspect and not elaborated hereinafter.

Figure 7:
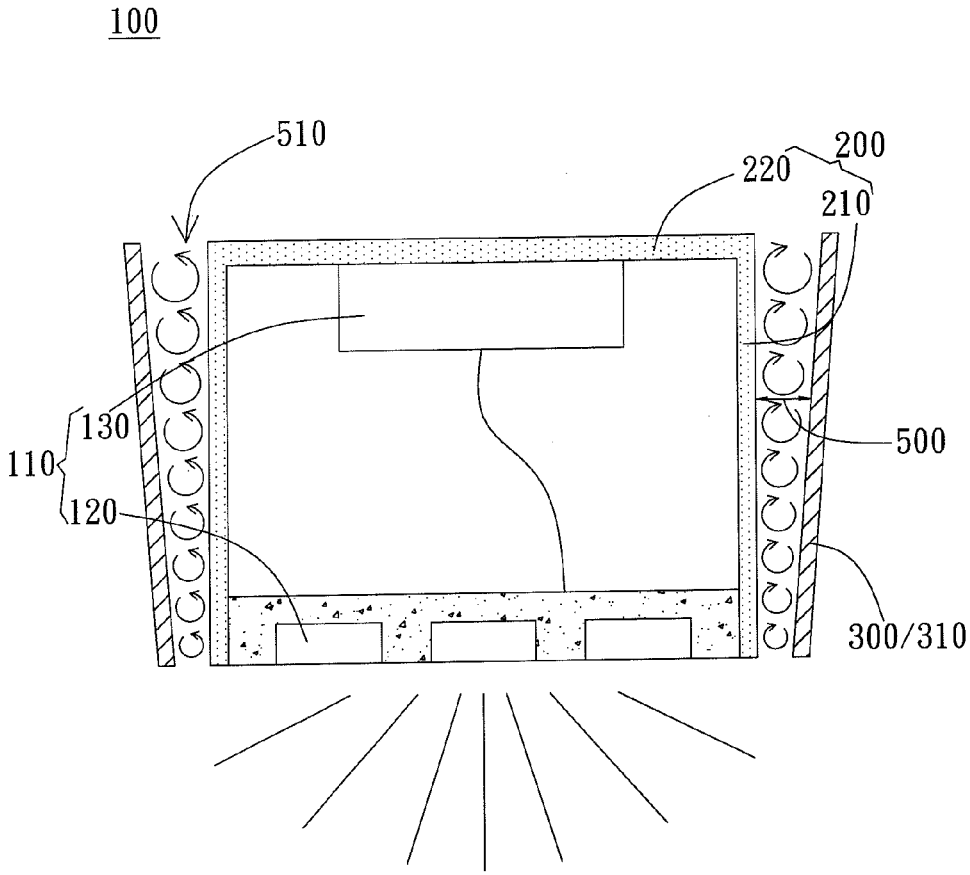
FIG. 7 is a variant embodiment of the light source cooling device of the present invention.

FIG. 7 is a variant embodiment of the cooling device 100 of the present invention. As shown in FIG. 7, the gap 500 included between the inner wall 210 and the outer wall 310 gradually increases from the bottom to the top of the cooling device 100. In other words, the extending direction of the inner wall 210 is essentially not parallel to the extending direction of the outer wall 310. Because the width of opening of the heat-dissipating passage 510 near the top of the cooling device 100 is larger, less air resistance exists near the top of the heat-dissipating passage 510. That is, air can more easily flows through the heat-dissipating passage 510 of the present embodiment, and the effect of natural convection is more significant, further exchanging more thermal energy and carrying out more wasted heat to decrease the temperature of the system.

Figure 8:
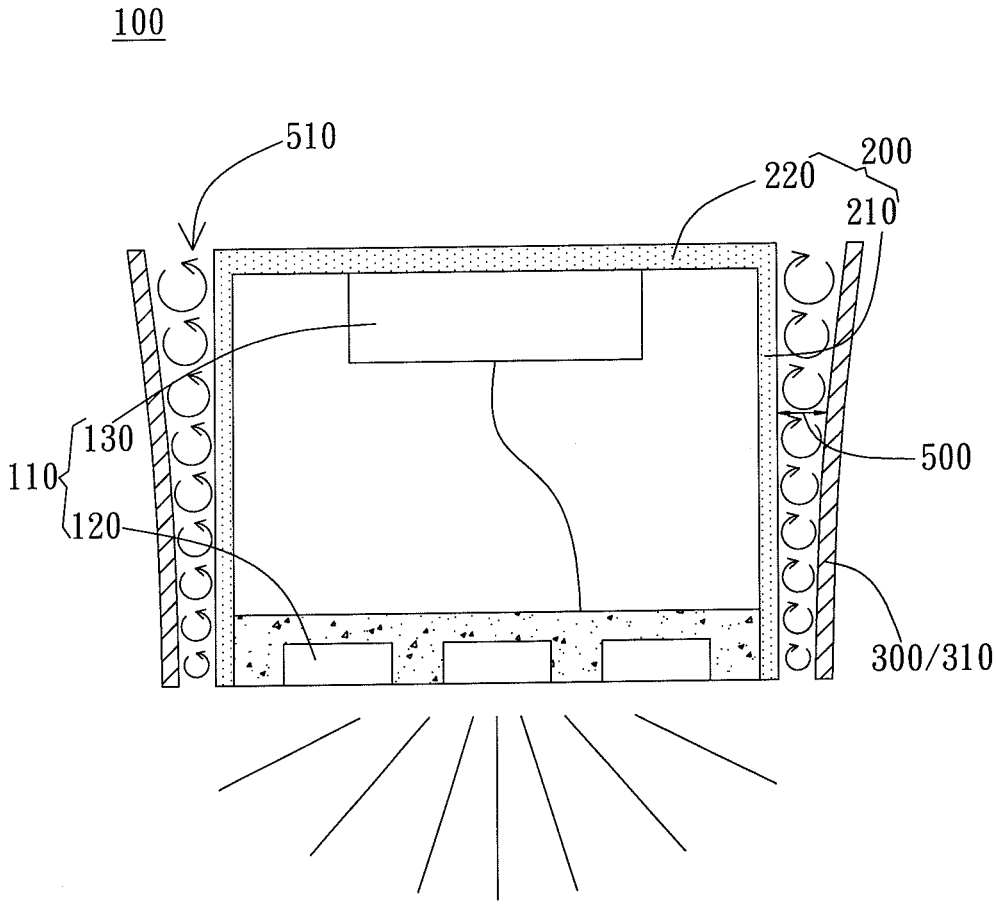
FIG. 8 is another variant embodiment of the light source cooling device of the present invention.

FIG. 8 is another variant embodiment of the cooling device 100 of the present invention. In the present embodiment, the outer wall 310 extends from the bottom of the cooling device 100 and, near the top of the cooling device 100, bends outward in a direction away from the inner wall 210. In other words, the outer wall 310 of the present embodiment forms a curved surface and bends outward relative to the inner wall 210. As such, the width of the gap 500 between the inner wall 210 and the outer wall 310 increases toward the top of the cooling device 100. Similarly, because the width of opening of the heat-dissipating passage 510 near the top of the cooling device 100 is larger, less air resistance exists near the top of the heat-dissipating passage 510. That is, the effect of the natural convection in the heat-dissipating passage 510 of the present embodiment is significant, and the air flows faster, further increasing the effect of exchanging thermal energy.

Figure 9:
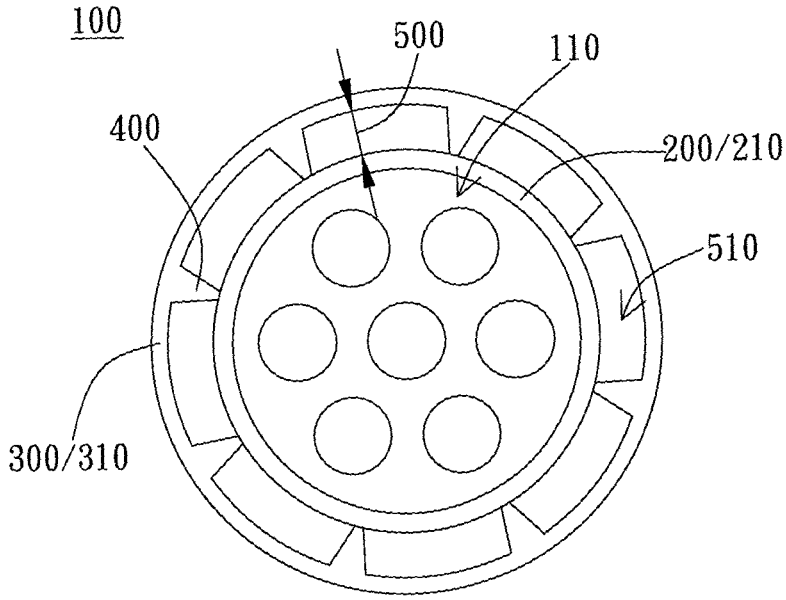
FIG. 9 is a top view of another embodiment of the light source cooling device of the present invention.

In the embodiments shown in FIGS. 7 and 8, the width of the gap 500 between the inner wall 210 and the outer wall 310 increases from the bottom of the inner wall 210 near the light-emitting module 120 toward the top of the inner wall 210, but not limited thereto; in the embodiment shown in FIG. 9, the width of the gap 500 between the inner wall 210 and the outer wall 310 can selectively decrease from the bottom of the inner wall 210 near the light-emitting module 120 toward the top of the inner wall 210 according to the heat dissipation requirements or other performances of the cooling device 100. The operation and the structure of the cooling device 100 shown in FIGS. 7 and 8 are essentially the same as the cooling device 100 shown in FIG. 4 and not elaborated hereinafter.

FIG. 9 is a top view of another embodiment of the cooling device 100 of the present invention. Compared to the cooling device 100 shown in FIG. 3, the width of the spacer 400 of the present embodiment near the inner wall 210 is smaller than the width of the spacer 400 near the outer wall 310. In other words, the width of the spacer 400 decreases along the extending direction from the outer wall 310 toward the inner wall 210. Therefore, the capability of the inner casing 200 transmitting the thermal energy to the outer casing 300 via the spacer 400 slightly decreases. That is, the cooling device 100 of the present embodiment maintains the temperature gradient in the heat-dissipating passage 510 by decreasing the conduction effect of the spacer 400, further continuously generating the spinning vortexes in the heat-dissipating passage 510 to carry the waste heat generated from the light source module 110 out of the cooling device 100. In addition, the operation and the structure of the cooling device 100 of the present embodiment are essentially the same as the cooling device 100 shown in FIG. 3 and not elaborated hereinafter.

Figure 10:
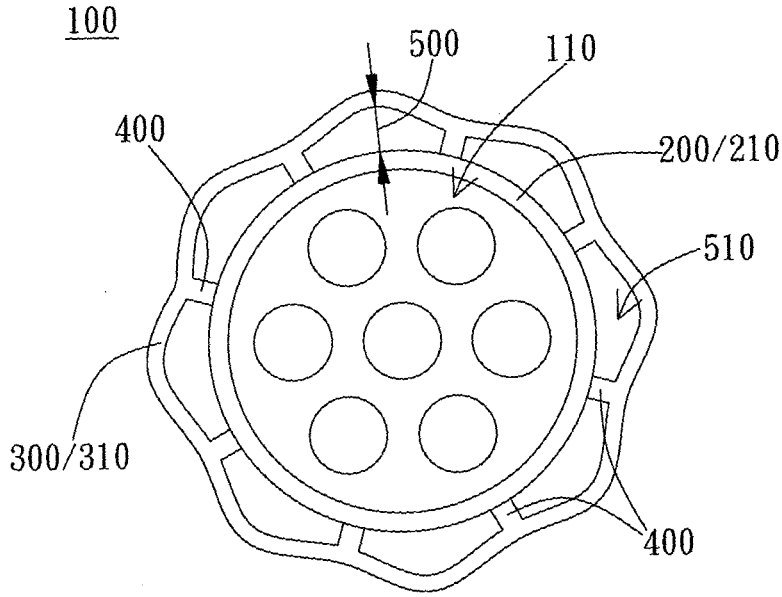
FIGS. 10 through 12 are variant embodiments of the light source cooling device of the present invention.
Figure 11:
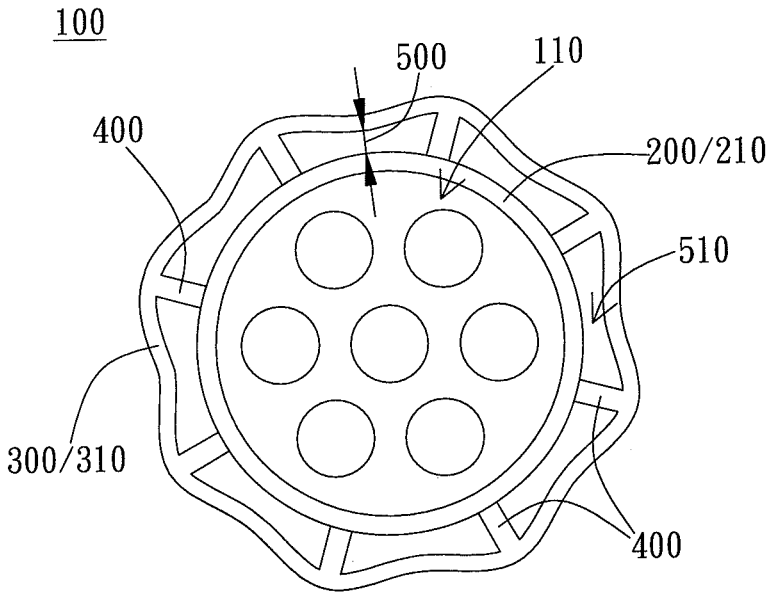
Figure 12:
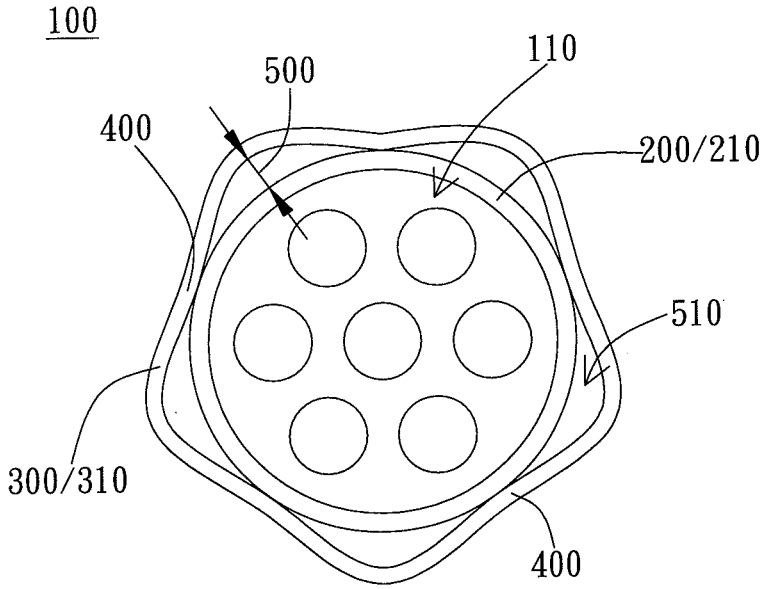

FIGS. 10 through 12 are variant embodiments of the cooling device 100 of the present invention. As shown in FIGS. 10 through 11, the outer wall 310 waves along a circumferential direction of the inner casing 200. Because the width of the gap 500 essentially varies with the shape of the outer wall 310 that surrounds the inner casing 200, the width of the gap 500 of the embodiments shown in FIGS. 10 and 11 varies along the wave of the outer wall 310 to increase or to decrease in the circumferential direction of the inner casing 200.

In the embodiment shown in FIG. 10, the spacer 400 connects the inner casing 200 with the portion of the outer casing 300 that is nearest the inner portion 200. The gap in the middle part of the heat-dissipating passage 510 formed by the inner casing 200, the outer casing 300, and the spacer 400 is wider, so that the air resistance is less. That is, the heat-dissipating passage 510 of the present embodiment can effectively facilitate the vortexes of the heat-dissipating passage 510 to carry the waste heat generated from the light source module 110 out of the cooling device 100.

In the embodiment in FIG. 11, the spacer 400 connects the inner casing 200 with the portion of the outer casing 300 that is farthest from the inner casing 200. The spacer 400 of the present embodiment is longer, so that the ability of the inner casing 200 transmitting the thermal energy to the outer casing 300 via the spacer 400 decreases. That is, the cooling device 100 of the present embodiment maintains the temperature gradient in the heat-dissipating passage 510 by decreasing the conduction effect of the spacer 400, further continuously generating the spinning vortexes in the heat-dissipating passage 510 to carry the waste heat generated from the light source module 110 out of the cooling device 100.

In addition, the width of the gap 500 is dependent on the position that the spacer 400 connects the outer wall 310 and the wave of the outer wall 310. In the embodiment shown in FIG. 10, the width of the gap 500 increases from one spacer 400 toward the middle part of the heat-dissipating passage 510 and then decreases from the middle part toward another spacer 400, but the width is not limited to the embodiment. As shown in FIG. 11, the width of the gap 500 decreases from one spacer 400 toward the middle part of the heat-dissipating passage 510 and then increases from the middle part toward another spacer 400.

In the embodiment of FIG. 12, the width of the gap 500 increases from the side of the spacer 400 toward the middle part of the heat-dissipating passage 510. The volume of the heat-dissipating passage 510 and the heat-dissipating/transmission efficiency are modified by changing the outer wall 310 and the width of the gap 500 in this embodiment. In addition, the spacer 400 of the cooling device shown in FIG. 12 is essentially the portion of the outer casing 300 that connects the inner casing 200. The gap of the middle part of the heat-dissipating passage 510 formed by the inner casing 200, the outer casing 300, and the spacer 400 is wider, so that the air resistance is less. That is, the heat-dissipating passage 510 of the present embodiment can effectively facilitate the vortexes of the heat-dissipating passage 510 to carry the waste heat generated from the light source module 110 out of the cooling device 100.

In addition, the operation and the structure of the cooling device 100 shown in FIGS. 10 through 12 are essentially the same as the cooling device 100 shown in FIG. 3 and not elaborated hereinafter.

Figure 13:
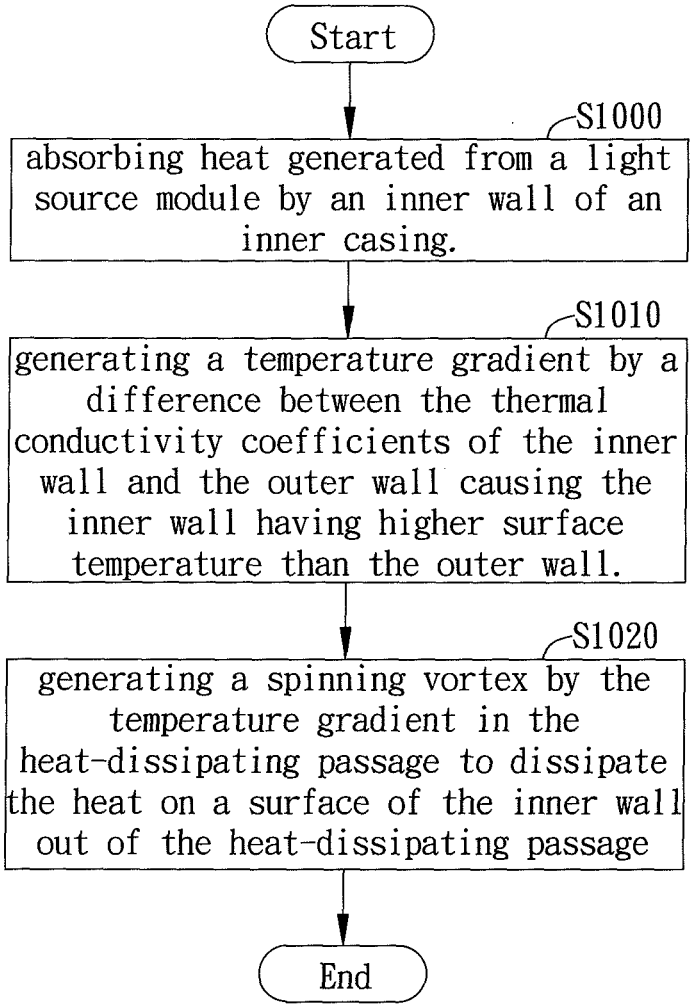
FIG. 13 is a flowchart of the cooling method of a light source cooling device of the present invention.

FIG. 13 is a flowchart of light source cooling method by means of the cooling device of the present invention. The method shown in FIG. 13 includes a step S1000 of absorbing heat generated from a light source module by an inner wall of an inner casing. Please refer to FIGS. 4 and 5, FIG. 6, FIG. 7, or FIG. 8. The light source module of the embodiment generates light and the waste heat according to the electrical signal transmitted from the driving module, wherein the waste heat is absorbed by the inner wall containing the light source module, and thus the temperature of the inner wall is increased.

The cooling method of the present embodiment further includes a step S1010 of generating a temperature gradient by a difference between the thermal conductivity coefficients of the inner wall and the outer wall causing the inner wall having higher surface temperature than the outer wall. As the light source module continues generating light, the overall temperature of the inner wall of the inner casing will become uniform. In addition, the inner casing and the outer casing are preferably made of materials having different thermal conductivity coefficients, wherein the thermal conductivity coefficient of the inner casing is larger than the thermal conductivity coefficient of the outer casing. Since the thermal conductivity coefficient of the outer wall is smaller than the thermal conductivity coefficient of the inner wall, the thermal energy dissipated from the surface of the inner wall 210 will not cause the surface temperature of the outer wall 310 to significantly increase. That is, the difference in temperatures between the inner wall and the outer wall is very significant.

The cooling method shown in FIG. 13 further includes a step S1020 of generating a spinning vortex by the temperature gradient in the heat-dissipating passage to dissipate the heat on a surface of the inner wall out of the heat-dissipating passage. The difference in temperature between the surfaces of the inner wall and the outer wall generates a temperature gradient. In the temperature gradient, the air near the inner wall having higher temperature moves to the outer wall due to natural convection. That is, a plurality of spinning vortexes are generated in the heat-dissipating passage 510. The temperature of the inner wall 210 is higher than the outer wall 310, so that the vortexes spin and simultaneously move toward the top of the heat-dissipating passage 510 to dissipate the waste heat generated from the light source module 110 out of the cooling device 100. In other words, the vortexes generated from the temperature gradient of the heat-dissipating passage 510 effectively carry the waste heat out of the cooling device 100.

In other embodiments, the cooling method of the present invention further includes disposing the spacers between the inner wall and the outer wall to maintain the width. In other words, the spacer prevents the inner wall from getting too close to the outer wall, transferring too much thermal energy from the inner wall through the air to the outer wall. That is, the spacer avoids that the inner wall transfers too much thermal energy toward the outer wall to decrease the temperature gradient between the inner wall and the outer wall.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A cooling device, comprising:

an inner casing having a supporting portion and an inner wall enclosing the supporting portion to form an accommodation space, wherein the inner casing is made of a first material having a first thermal conductivity coefficient;

an outer casing having an outer wall surrounding the inner casing with a gap included between the outer wall and the inner wall; wherein the outer casing is made of a second material having a second thermal conductivity coefficient smaller than the first thermal conductivity coefficient; and a plurality of spacers located within the gap to maintain the width of the gap between the outer wall and the inner wall, wherein the outer wall, the inner wall, and the spacers together form a plurality of heat-dissipating passages, the heat-dissipating passages have openings located at the top and the bottom.

2. The cooling device of claim 1, wherein each of the spacers extends from an inner surface of the outer wall toward the inner wall and is connected to an outer surface of the inner wall.

3. The cooling device of claim 1, wherein the spacers are made of the second material.

4. The cooling device of claim 1, wherein the thermal conductivity coefficient of the spacers is smaller than the first thermal conductivity coefficient.

5. The cooling device of claim 1, wherein the width of the spacer near the inner wall is smaller than the width of the spacer near the outer wall.

6. The cooling device of claim 1, wherein the spacers and the heat-dissipating passages are distributed radically and alternatively in the gap.

7. The cooling device of claim 1, wherein a ratio of the height of the inner wall to the width of the gap is in a range between 10 and 40.

8. The cooling device of claim 1, wherein the width of the gap increases or decreases from the bottom of the inner wall toward the top of the inner wall.

9. The cooling device of claim 8, wherein the outer wall forms a curved surface and bends outward relative to the inner wall.

10. The cooling device of claim 1, wherein the width of the gap varies along a direction that the outer wall surrounds the inner casing.

11. The cooling device of claim 10, wherein the outer wall waves along a circumferential direction of the inner casing.

12. A light source cooling device, comprising:

a light source module;

an inner casing having a supporting portion and an inner wall enclosing the supporting portion to form an accommodation space containing the light source module, wherein the inner casing is made of a first material having a first thermal conductivity coefficient;

an outer casing having an outer wall surrounding the inner casing with a gap included between the outer wall and the inner wall; wherein the outer casing is made of a second material having a second thermal conductivity coefficient smaller than the first thermal conductivity coefficient; and a plurality of spacers located within the gap, wherein the outer wall, the inner wall, and the spacer together form a plurality of heat-dissipating passages, the heat-dissipating passages have openings located at the top and the bottom; the inner wall absorbs the heat from the light source module to generate a temperature gradient between the inner wall and the outer wall, which assists to create a convection to exhaust the heat.

13. The light source cooling device of claim 12, wherein each of the spacers extends from an inner surface of the outer wall toward the inner wall and is connected to an outer surface of the inner wall.

14. The light source cooling device of claim 12, wherein the spacer is made of the second material.

15. The light source cooling device of claim 12, wherein the thermal conductivity coefficient of the spacers is smaller than the first thermal conductivity coefficient.

16. The light source cooling device of claim 12, wherein the width of the spacer near the inner wall is smaller than the width of the spacer near the outer wall.

17. The light source cooling device of claim 12, wherein the spacers and the heat-dissipating passages are distributed radically and alternatively in the gap.

18. The light source cooling device of claim 12, wherein a ratio of the height of the inner wall to the width of the gap is in a range between 10 and 40.

19. The light source cooling device of claim 12, wherein the width of the gap increases or decreases from the bottom of the inner wall toward the top of the inner wall.

20. The light source cooling device of claim 12, wherein the outer wall forms a curved surface and bends outward relative to the inner wall.

21. The light source cooling device of claim 13, wherein the width of the gap varies along a circumferential direction of the inner casing.

22. The light source cooling device of claim 21, wherein the outer wall waves along a direction that the outer wall surrounds the inner casing.

23. A cooling method of the light source cooling device of claim 12, the cooling method comprising:

(a) absorbing heat generated from the light source module by the inner wall of the inner casing;

(b) generating a temperature gradient by a difference between the thermal conductivity coefficients of the inner wall and the outer wall causing the inner wall having higher surface temperature than the outer wall; and (c) in the temperature gradient, generating a spinning vortex by air in the heat-dissipating passage to dissipate the heat on a surface of the inner wall out of the heat-dissipating passage.

24. The cooling method of claim 23, wherein the step (c) further comprises:

(c1) disposing the spacers between the inner wall and the outer wall to maintain the width for limiting the heat on the inner wall being transferred to the outer wall.

* * * * *